United States Patent [19]

Change, III

[11] Patent Number: 4,720,140

[45] Date of Patent: Jan. 19, 1988

[54] ROTATING PLATFORM FOR SUNBATHERS

[76] Inventor: Nicholas D. Change, III, 91592 Marilla St., Chatsworth, Calif. 91311

[21] Appl. No.: 43,531

[22] Filed: Apr. 28, 1987

[51] Int. Cl.[4] ..... A47C 7/62

[52] U.S. Cl. ..... 297/217; 104/45; 108/94; 248/349; 297/349

[58] Field of Search ..... 297/217, 349, 261, 263, 297/269, 17; 108/94, 103, 139; 248/349; 104/44, 45; 272/144

[56] References Cited

U.S. PATENT DOCUMENTS

| | | | |
|---|---|---|---|
| 1,237,022 | 8/1917 | Craig | 104/44 |
| 1,532,728 | 4/1925 | Brobst | 104/45 X |
| 1,689,160 | 10/1928 | Siegrist | 108/139 X |
| 1,735,320 | 11/1929 | Kilburn | 297/349 |
| 2,264,128 | 11/1941 | Branch | 108/139 |
| 2,409,805 | 10/1946 | Shikles | 297/217 X |
| 2,938,571 | 5/1960 | Simmerman | 297/217 X |
| 3,475,050 | 10/1969 | Leahy | 297/17 |
| 4,032,099 | 6/1977 | Maude | 272/144 X |
| 4,379,588 | 4/1983 | Speice | 297/217 |
| 4,544,202 | 10/1985 | Keaton | 297/349 |
| 4,579,473 | 4/1986 | Brugger | 248/349 X |

FOREIGN PATENT DOCUMENTS

| | | | |
|---|---|---|---|
| 826959 | 1/1952 | Fed. Rep. of Germany | 297/349 |
| 846349 | 9/1939 | France | 297/349 |
| 1408575 | 10/1975 | United Kingdom | 104/44 |

*Primary Examiner*—Peter A. Aschenbrenner
*Assistant Examiner*—Thomas A. Rendos

[57] ABSTRACT

An elongated platform is disclosed herein for supporting a person in a chair or recliner which is adapted to rotate about a central pivot support and having wheels arranged in an arc adjacent to the opposite ends of the platform. The exposed upper surface is provided with a pair of spaced apart grooves or recesses for insertably receiving the standard rungs of the chair or recliner. Snap-lock latches releasably retain the rungs in position so that the chair or recliner and the platform constitute a unitary structure.

4 Claims, 6 Drawing Figures

ROTATING PLATFORM FOR SUNBATHERS

BACKGROUND OF THE INVENTION

1. Field of the Invention

The present invention relates to sunbathers' accessories and more particularly to a novel platform for releasably securing a conventional chair or recliner thereto and having means permitting rotation of the platform about a central pivot point so that the sunbather may select his exposure to the sun.

2. Brief Description of the Prior Art

In the past, it has been the conventional practice for sunbathers to merely rest or recline on the ground in order to obtain a suntan. This procedure necessitates that the sunbather repeatedly move his body to a new location as the sun traverses the sky. Also, should the sunbather desire to expose more surface on one side than the other to the sun's rays, it is necessary to re-orient his body with respect to the sun in order to achieve this purpose.

In order to avoid some of these problems, large and cumbersome decks have been employed for supporting a person and for orienting the person's body with respect to the sun. However, such prior devices either rest in the water and do not accommodate a standard chair or recliner. Also, those devices which involve revolving decks or platforms, lack the means for supporting the conventional chair or recliner in a releasable manner so that the platform is readily transportable.

Therefore, a long standing need has existed to provide a platform which will readily accommodate various sizes of chairs or recliners and which supports the chair and its occupant in a manner permitting rotation whereby a variety of positions can be obtained with respect to the sun's trajectory.

SUMMARY OF THE INVENTION

Accordingly, the above problems and difficulties are obviated by the present invention which provides a novel elongated platform carried on a central pivot so as to be turned thereon and which includes a plurality of rollers arranged in an arc on opposite ends of the platform for rotatably supporting the platform in combination with the central pivot. A pair of elongated recesses is provided on the exposed surface of the platform in fixed spaced apart relationship that is adapted to accommodate insertion of the support rungs from a conventional chair or recliner so that the chair or recliner and its occupant are supported on the platform. Means are incorporated into the platform for releasably holding the rungs of the chair or recliner in position and additional means are provided for accommodating a variety of different size chair or recliner rungs.

Therefore, it is among the primary objects of the present invention to provide a novel rotatable platform for supporting a chair or the like along with its occupant so that the person is exposed to the rays of the sun.

Another object of the present invention is to provide a novel turntable-type platform supported on peripheral rollers and which supports a chair or recliner as part of a unitary structure for movably supporting the occupant of the chair or recliner.

Still another object of the present invention is to provide a novel platform readily adaptable to receive a variety of chairs, recliners or the like on which occupants may be exposed to the sun and which further includes releasable means for detachably connecting the chair or recliner to the platform.

A further object of the present invention resides in the provision of a sunbathing device adapted to support a chair and its occupant in a rotary manner and which is portable so as to be transportable from one location to another with convenience and ease.

Yet another object of the present invention is to provide a novel sunbather's movable platform which is relatively easy to make and which is economical to manufacture and which does not require difficult installation or assembly.

Another object resides in providing a rotatable support adapted to accommodate a variety of chairs having different spacing or dimensional distances between spaced apart support rungs.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
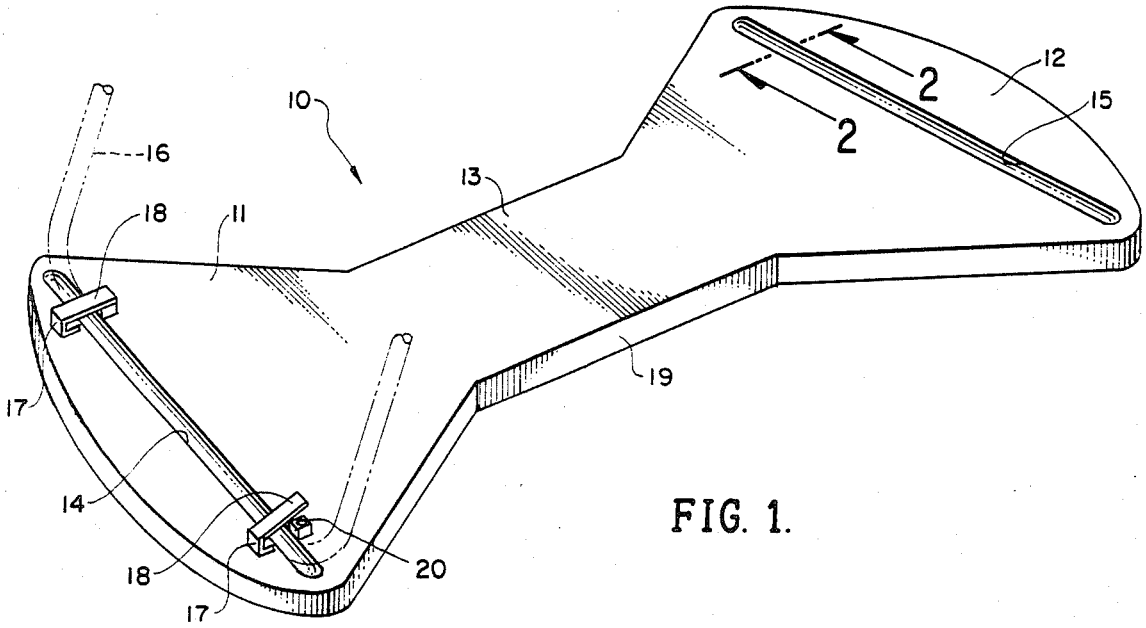
FIG. 1 is a front perspective view of the novel sunbather's platform incorporating the present invention.

Referring to FIG. 1, the novel sunbather's platform of the present invention is illustrated in the general direction of arrow 10 which includes an elongated platform or base having end portions 11 and 12 connected together by a midsection 13 which is of reduced width as compared to the end portions 11 and 12. Preferably, the platform or base is hollow and is composed of upper and lower panels which are joined together by a continuous sidewall so that the platform or base has substantial thickness in order to support the weight of a chair or recliner including its occupant during the sunbathing procedure. The upper panel is provided with a pair of elongated recesses or grooves 14 and 15 which are arranged in fixed parallel spaced apart relationship and are carried on the respective end portions 11 and 12. The recesses or grooves are intended to receive the supports or rungs from a standard or conventional chair or recliner. Such a standard chair support or rung is illustrated in broken lines and is identified in general by the numeral 16. As is the customary practice, the standard chair or recliner rung is of tubular material and is of an elongated support terminating in upward parallel bends. The recess or groove 14 is of sufficient length to accommodate the length of the standard rung or chair support member.

A feature of the present invention resides in the provision of a releasable means for holding the chair support or rung in position. In one form, an over center snap-lock arrangement is illustrated and includes a fixed support 17 having a pivoted retainer 18 adapted to cross over the top of the support or rung and to snap-lock fasten with a retainer 20. It is also envisioned that other fastening means can be employed such as a hook and pile fastener type. If desired, similar releasable retaining means can be placed to cooperate with the groove 15. However, only one set of retainer means is illustrated.

Figure 1A:
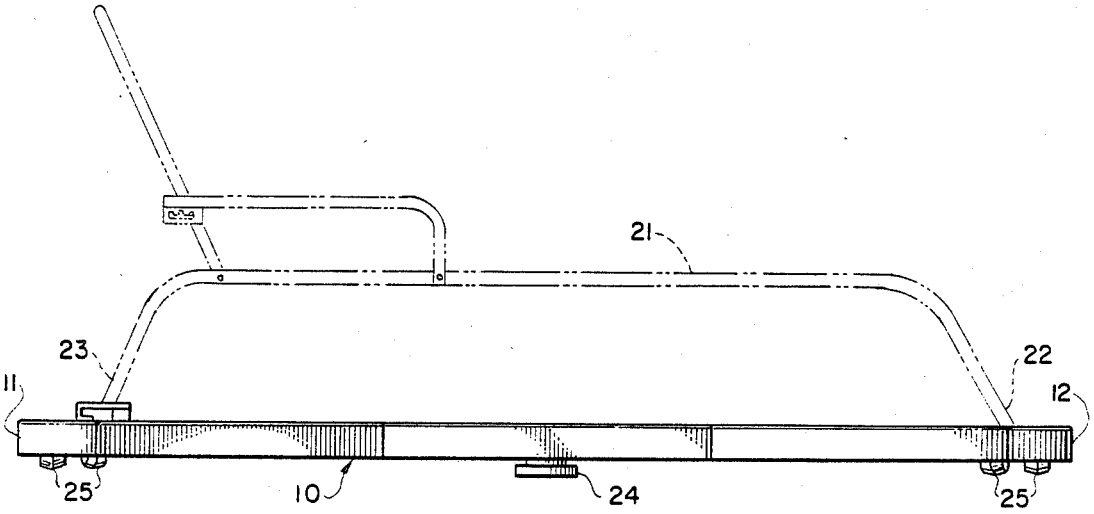
FIG. 1*a* is a reduced side elevational view of the platform shown in FIG. 1 illustrating a chair or recliner detachably carried thereon.

Referring now in detail to FIG. 1*a*, it can be seen that the platform or base 10 supports a typical recliner identified by numeral 21 in which the front leg support 22 is within the elongated groove 15 while the rear support 23 is in the groove 14 carried on end portion 11. The platform or base 10 is primarily supported on a supporting surface such as the ground, swimming pool deck or the like by means of a center pivot 24 and rollers, such as roller 25 carried on the underside of the end portions 11 and 12 respectively. Therefore, the platform 10 is similar to a turntable revolving about the central pivot 24 having its end portions supported by the rollers 25.

Figure 2:
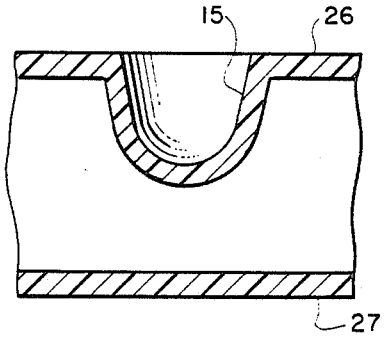
FIG. 2 is an enlarged transverse cross-sectional view of the platform shown in FIG. 1 as taken in the direction of arrows 2—2 thereof.

Referring now in detail to FIG. 2, it can be seen that the platform or base 10 includes an upper panel 26 which is arranged in spaced apart relationship to the lower panel 27 by means of the continuous sidewall 19. The groove 15 is closed at its opposite ends and includes sidewalls defining opposing surfaces of the groove which are arranged at approximately a 15° angle diverging outwardly from the bottom of the groove or recess. Thus, each groove or recess will receive a support member such as a tube of a chair of different diameters. Also, to accommodate support members which are of different lengths, the grooves 14 and 15 are constructed longer than the standard chair or recliner support members. By closing the ends of the grooves or recesses, the support members will not slide or be dislodged from the grooves during the sunbathing procedure.

Figure 3:
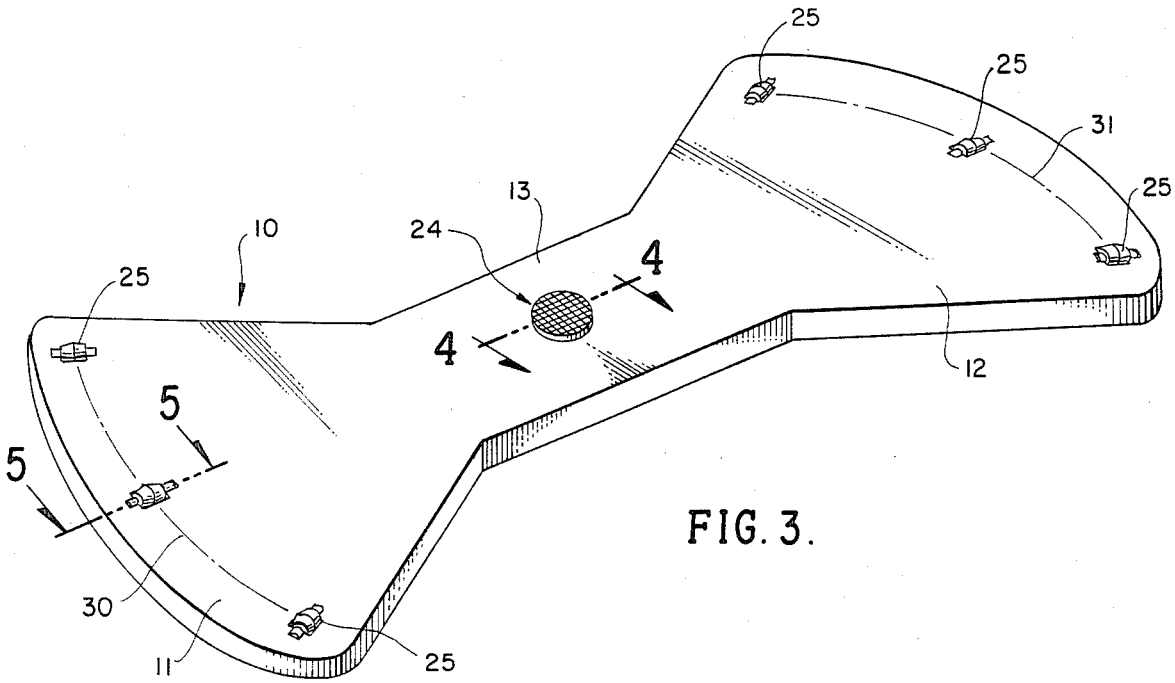
FIG. 3 is a perspective view of the underside of the platform shown in FIG. 1.

Referring now in detail to FIG. 3, the underside of the sunbathing platform or base is illustrated wherein it can be seen that the central pivot means 24 is located on the undersurface of the midsection 13 between the opposite end portions 11 and 12. Also, it can be seen that the roller means carried by the opposite end portions are arranged in an arc along the curved axes represented by numerals 30 and 31. In the present illustration, at least 3 rollers are carried on each end portion and are arranged on the arcuate axis. It is also to be noted that the central pivot 24 is of slightly greatly height than the rollers 25 so that the pivoting action is not impaired. For example, the height of the central pivot means can be one-half inch while the height of the rollers beneath the surface of panel 27 can be 0.40 inch.

Figure 4:
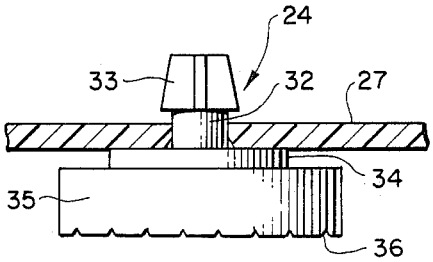
FIG. 4 is an enlarged cross-sectional view of the center pivot means used on the platform shown in FIG. 3 as taken in the direction of arrows 4—4 thereof.

Referring now in detail to FIG. 4, it can be seen that the center pivot means includes a shaft 32 having a tapered detent 33 on its one end a washer head 34 on its opposite end. The detent 33 is snapped through a conical opening in the panel 27 so that the detent will spread on the opposite surface from the surface through which it's inserted to thereby attain retention. The shank 32 is long enough so as to permit ready rotation without binding for encumberment. The pivot means further includes a support pad 35 carried on the shank that includes a roughened or irregular bottom surface 36 intended to engage with the supporting surface such as the ground or swimming pool deck. In one form of the invention, the roughened surface is in the form of a grid of ridges and such an arrangement is more clearly seen in FIG. 3.

Figure 5:
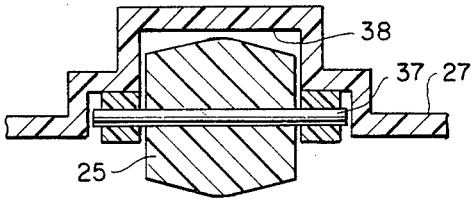
FIG. 5 is a transverse cross-sectional view of the support roller taken in the direction of arrows 5—5 of FIG. 3.

Referring now in detail to FIG. 5, roller 25 is illustrated as being mounted on an axis 37 held by retainers in a well 38 formed in the panel 27. Only a portion of the roller extends beyond the surface of the panel 27 while the remainder of the roller extends into the well 38.

Therefore, it can be seen that the inventive sunbather's platform of the present invention may readily accommodate in a releasable fashion a variety of chairs, recliners, stools or the like. Means are provided for releasably retaining the chair or recliner onto the platform and the chair, recliner and its occupant are pivotally carried on the central pivot support 24. Loads are passed to the supporting surface such as the ground or deck not only through the central supporting means 24 but through the plurality of rollers 25 that are arranged along the curved axes 30 and 31. The midsection of the base or platform is substantially narrower than the end portions so that a great weight reduction is experienced. The platform may be readily rotated manually by the sunbather himself or by others; however, it is to be understood that motor means can also be employed for turning the platform on the pivot means. Such a motor means can be tied into a timer so that the platform is moved at a constant speed so that the sun's trajectory can be followed providing correct exposure of sunlight to the sunbather.

A variety of chairs having different spacing between support rungs is accommodated by providing at least one groove or recess 14 or 15 with tapered sidewalls which define an enlarged entrance leading into the support cavity. FIG. 2 shows such construction.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A revolving apparatus for sunbathers occupying a chair of recliner comprising:

a chair or recliner having support rungs;

an elongated platform having opposite end portions integrally joined together by a midsection of reduced width;

a central pivot means disposed on the underside of said platform midsection;

roller means carried on the underside of platform end portions arranged on an arcuate axis coaxially disposed with respect to said pivot means; and means provided on the upper surface of said platform for releasably retaining said chair or recliner when occupied on said platform;

said central pivot means is of a greater height than the height of said roller means to permit flexing of said platform opposite end portions about said pivot to engage said roller means with the ground.

2. The invention as defined in claim 1 wherein:

said retaining means includes a pair of parallel spaced apart recesses provided in said platform separated by said midsection for receiving said chair or recliner support rungs.

3. The invention as defined in claim 2 including:

retainers carried on said platform adjacent to at least one recess for releasably retaining said chair or recliner in said recess.

4. The invention as defined in claim 3 wherein:

said retainers are snap-lock devices integrally carried and fixed onto said platform so as to provide a unitized construction.

* * * * *